United States Patent [19]

Ookawa

[11] Patent Number: 5,044,348

[45] Date of Patent: Sep. 3, 1991

[54] IGNITER FOR AN INTERNAL COMBUSTION ENGINE

[75] Inventor: Kiyoshi Ookawa, Himeji, Japan

[73] Assignee: Mitsubishi Denki K.K., Tokyo, Japan

[21] Appl. No.: 413,509

[22] Filed: Sep. 27, 1989

[30] Foreign Application Priority Data

Sep. 27, 1988 [JP] Japan ..... 63-239746

[51] Int. Cl.[5] ..... F02P 3/08; F02P 15/00

[52] U.S. Cl. ..... 123/637; 123/640; 123/655

[58] Field of Search ..... 123/143 B, 620, 637, 123/640, 655

[56] References Cited

U.S. PATENT DOCUMENTS

| | | | |
|---|---|---|---|
| 4,004,561 | 1/1977 | Thieme | 123/637 X |
| 4,029,072 | 6/1977 | Goto et al. | 123/655 X |
| 4,068,643 | 1/1978 | McKechnie | 123/637 X |
| 4,091,787 | 5/1978 | Frank | 123/637 X |
| 4,103,659 | 8/1978 | Donigian | 123/655 |
| 4,138,710 | 2/1979 | Tsukuru | 123/655 X |
| 4,395,999 | 8/1983 | McKechnie | 123/655 X |
| 4,556,040 | 12/1985 | Heyke | 123/655 X |

*Primary Examiner*—Tony M. Argenbright

*Attorney, Agent, or Firm*—Sughrue, Mion, Zinn, Macpeak & Seas

[57] ABSTRACT

An igniter for an internal combustion engine has a plurality of drive circuits for generating an ignition voltage in the secondary winding of an ignition coil. A high-voltage diode is connected in series between the secondary winding of the ignition coil and a spark plug. The diode prevents destructive interference between the ignition voltages generated in the secondary winding for successive firings of the spark plug.

5 Claims, 2 Drawing Sheets

IGNITER FOR AN INTERNAL COMBUSTION ENGINE

BACKGROUND OF THE INVENTION

This invention relates to an igniter for an internal combustion engine. More particularly, it relates to an igniter for a multi-channel ignition system.

A multi-channel ignition system has a plurality of drive circuits connected to a single ignition coil. By individually controlling the drive circuits, the interval between successive firings of a spark plug can be adjusted. A drive signal from each drive circuit is applied to the same ignition coil. In a conventional multi-channel ignition system, when the interval between two successive firings becomes small, the drive signal from one drive circuit may overlap the drive signal from the other drive circuit, causing destructive interference in the secondary winding of the ignition coil. As a result, an ignition voltage having a desired peak value can not be generated in the secondary winding for the second of two successive firings, so the spark plug can not generate a good spark for the second firing.

SUMMARY OF THE INVENTION

It is an object of the present invention to provide an igniter for an internal combustion engine which can prevent destructive interference between the drive signals for successive firings of a spark plug.

An engine igniter in accordance with the present invention has an ignition coil and a plurality of drive circuits for generating ignition voltages in the secondary winding of the ignition coil. The secondary winding of the ignition coil is connected to a spark plug by a high-voltage diode which prevents a positive voltage from being generated in the secondary winding. When the interval between successive firings of the engine becomes small and ignition voltages in the secondary winding of the ignition coil overlap one another, since both voltages are of the same polarity, there can be no destructive interference between the two ignition voltages. Therefore, a high peak voltage can be generated in the secondary winding for each ignition.

DESCRIPTION OF THE PREFERRED EMBODIMENTS

Figure 1:
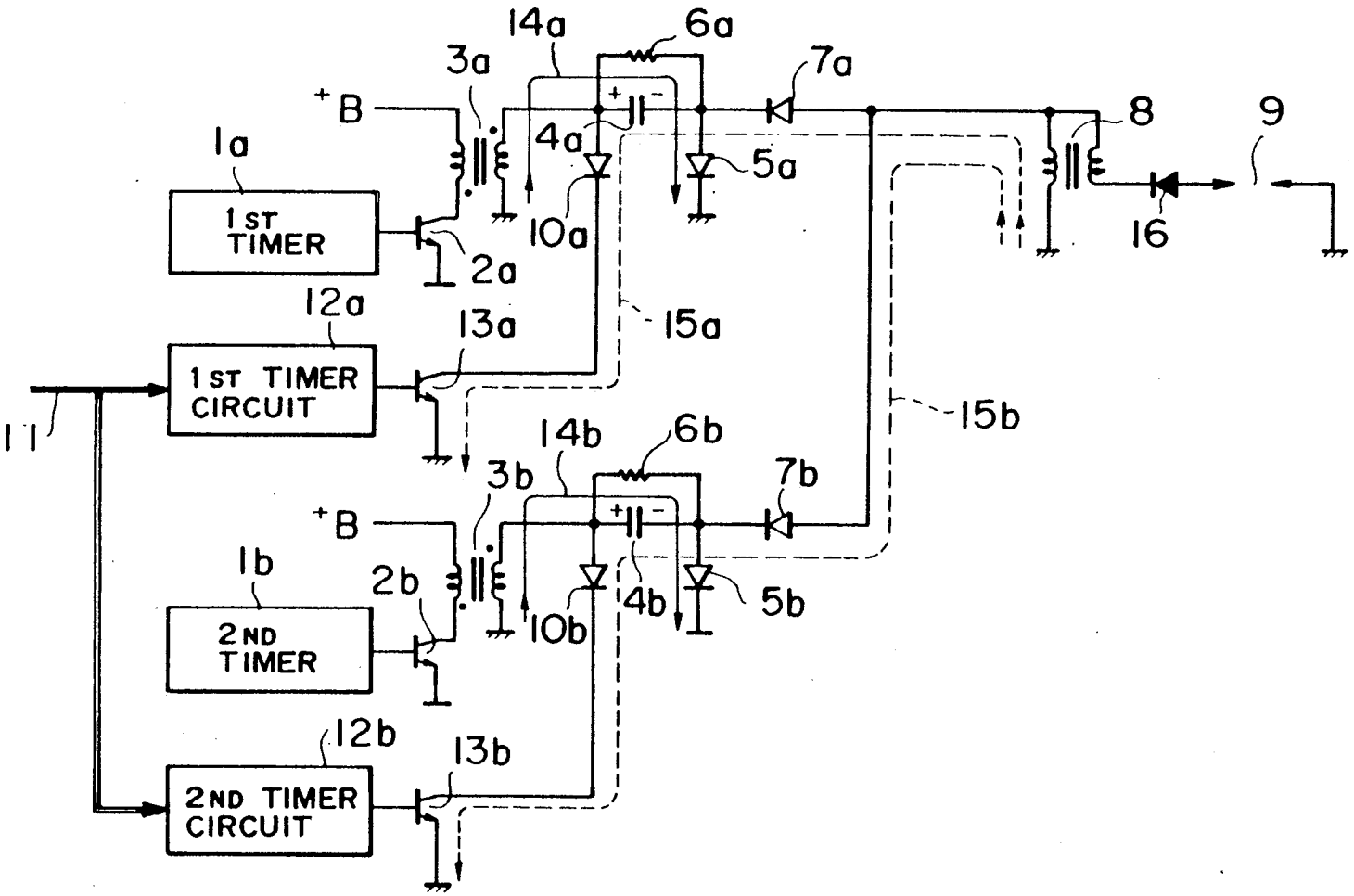
FIG. 1 is a circuit diagram of an embodiment of an engine igniter according to the present invention.

A preferred embodiment of an engine igniter according to the present invention will now be described while referring to the accompanying drawings. FIG. 1 is a circuit diagram of this embodiment, which is a two-channel igniter for double ignition. The igniter has a drive circuit for a first channel and an identical drive circuit for a second channel. The reference numerals for the elements of the first channel drive circuit are affixed with the letter "a", and the reference numerals for the elements of the second channel drive circuit are affixed with the letter "b". As the two drive circuits have the same structure, only that of the first drive circuit will be described. As shown in this figure, a timer 1*a* for the first channel is connected to an unillustrated engine controller which provides it with ignition timing signals. The timer 1*a* generates an output pulse having a prescribed pulse width which is input to the base of a drive transistor 2*a*. The collector of the drive transistor 2*a* is connected to one end of the primary winding of a step-up transformer 3*a*. A battery voltage B+is applied to the other end of the primary winding of the step-up transformer 3*a*. The emitter of transistor 2*a* is grounded. The above-described structure constitutes a voltage booster circuit (a DC—DC converter). One end of the secondary winding of transformer 3*a* is connected to one end of an energy storage capacitor 4*a*. The other end of the secondary winding of transformer 3*a* is grounded. A high-resistance resistor 6*a* is connected across capacitor 4*a*. One end of resistor 6*a* is connected to the anode of a diode 5*a* and the cathode of an interference-prevention diode 7*a* for preventing interference between the first and second channels, and the other end of resistor 6*a* is connected to the anode of another diode 10*a*. The anode of interference-prevention diode 7*a* is connected to the primary winding of an ignition coil 8. The secondary winding of the ignition coil 8 is connected to the cathode of a high-voltage diode 16, the anode of which is connected to a spark plug 9.

An ignition timing signal train is transmitted from the unillustrated engine controller by a signal bus 11 and is provided to a timer circuit 12*a* for the first channel. The timer circuit 12*a* generates an output pulse of a prescribed width which is applied to the base of transistor 13*a* and which controls the discharge of capacitor 4*a*. The collector of transistor 13*a* is connected to the cathode of diode 10*a* while its emitter is grounded.

Figure 2:
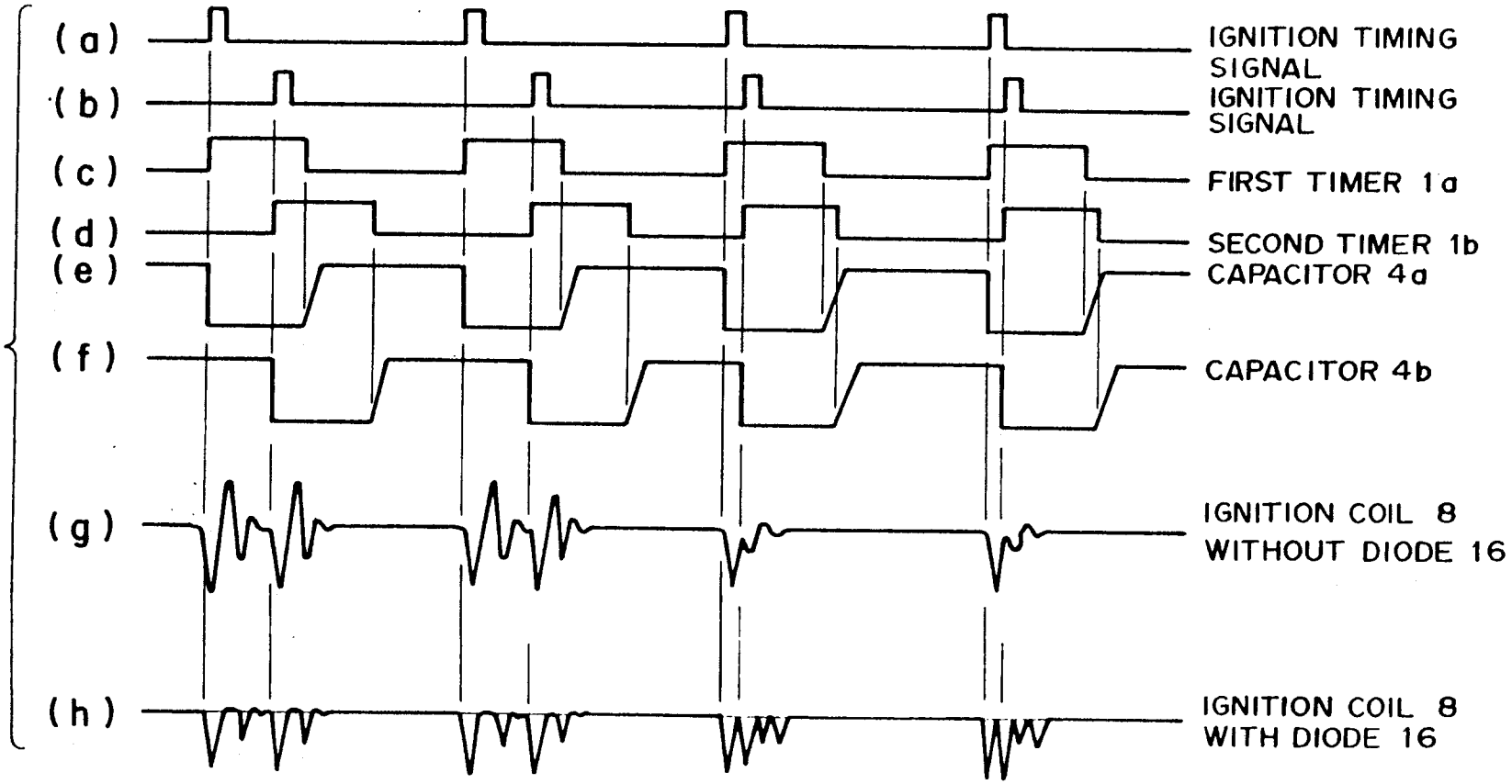
FIGS. 2(*a–h*) are a wave form diagram showing the output signals of various portions of the embodiment of FIG. 1.

The operation of this embodiment will be explained while referring to FIG. 2, which is a wave form diagram of the output signals of various portions of this embodiment. Lines (a) and (b) of FIG. 2 illustrate ignition timing signals which are input to the first timer 1*a* and the second timer 1*b* by the unillustrated controller. The controller varies the interval between successive timing signals in accordance with engine operating conditions. The first and second timers 1*a* and 1*b* are triggered by the ignition timing signals and generate output pulses of a prescribed width as shown in lines (c) and (d). These pulses are used to gate the drive transistors 2*a* and 2*b*, which conduct for the duration of the output pulses. When the levels of the output pulses of the timers 1*a* and 1*b* fall and drive transistors 2*a* and 2*b* stop conducting, a voltage is generated in the secondary windings of step-up transformers 3*a* and 3*b*, and capacitors 4*a* and 4*b* are charged with the illustrated polarity by charging currents which flow in the directions shown by lines 14*a* and 14*b*, respectively. When the capacitors 4*a* and 4*b* have been charged, in response to signals which are provided by the input bus 11, the first timer circuit 12*a* and the second timer circuit 12*b* each generate an output pulse of a prescribed width. These pulses cause transistors 13*a* and 13*b* to conduct, upon which capacitors 4*a* and 4*b* discharge their stored energy by the paths illustrated by lines 15*a* and 15*b*, respectively. Lines (e) and (f) illustrate the voltages across capacitors 4*a* and 4*b*, respectively, as they charge and discharge. When the capacitors 4*a* and 4*b* discharge, a high voltage is generated in the secondary winding of the ignition coil 8, and this voltage causes the spark plug 9 to fire.

Line (g) of FIG. 2 shows the voltage which would be generated in the secondary winding of the ignition coil 8 of a conventional engine igniter, in which the secondary winding of the ignition coil 8 is connected directly to the spark plug 9. In the absence of the high-voltage diode 16, current could flow through the secondary winding in both directions, so the voltage generated in the secondary winding of the ignition coil 8 would have both a positive and a negative component. When the intervals between two successive ignitions grow smaller, i.e., when the intervals between the timing signals for the first and second channels shown in lines (a) and (b) decrease, the ignition voltage in the secondary winding due to the discharge of capacitor 4*b* would begin to overlap the ignition voltage in the secondary winding due to the discharge of capacitor 4*a*, and the positive component of the voltage due to capacitor 4*a* would partly cancel out the negative component of the voltage due to capacitor 4*b*. As a result, the peak voltage for the second ignition would be greatly reduced, and a good spark could not be produced for the second ignition.

In contrast, in the present invention, the high-voltage diode 16 which is connected between the secondary winding of the ignition coil 8 and the spark plug 9 prevents a positive voltage from being generated in the secondary winding. Line (h) of FIG. 2 shows the ignition voltage in the secondary winding. It can be seen that because of the diode 16, the ignition voltage has only a negative component. Therefore, even when the interval between two successive ignitions grows small, the ignition voltages for the first ignition does not destructively interfere with the ignition voltage for the second ignition, and a high peak voltage can be obtained for both ignitions. Accordingly, a good spark can be generated by the spark plug for both ignitions.

The illustrated embodiment has only two different channels, but an engine igniter according to the present invention can have a larger number of channels.

What is claimed is:

1. An igniter for an internal combustion engine comprising:

an ignition coil having a primary winding and a secondary winding;

a plurality of drive circuits connected to the primary winding, each of said drive circuits applying a voltage to said primary winding so as to produce successive voltages applied to said primary winding, said successive voltages being separated from one another by an interval, said interval being varied in response to an ignition timing signal provided to said drive circuits;

a spark plug; and diode means for preventing a voltage of one polarity from being generated in the secondary winding of said ignition coil, said diode means connected in series between the secondary winding of the ignition coil and the spark plug.

2. An igniter as claimed in claim 1, wherein each drive circuit comprises:

an energy storage capacitor which is connected to the primary winding of the ignition coil; and means for charging and discharging the capacitor with a prescribed timing.

3. An igniter as claimed in claim 2, wherein each drive circuit further comprises a diode connected in series between the capacitor of the drive circuit and the primary winding of the ignition coil.

4. An igniter as claimed in claim 1, wherein said diode means comprises a high-voltage diode having an anode connected to said spark plug and a cathode connected to said secondary winding of the ignition coil.

5. An igniter as claimed in claim 1, wherein the number of said plurality of drive circuits is two.

* * * * *